US005961199A

United States Patent [19]

Lee

[11] Patent Number: 5,961,199

[45] Date of Patent: Oct. 5, 1999

[54] LIGHT PEN

[75] Inventor: Ching-Huang Lee, San-Chung, Taiwan

[73] Assignee: Ding Ares Enterprise Co., Ltd., Taipei Hsien, Taiwan

[21] Appl. No.: 09/131,599

[22] Filed: Aug. 10, 1998

[51] Int. Cl.[6] ..... B43K 29/10

[52] U.S. Cl. ..... 362/34; 362/118

[58] Field of Search ..... 362/34, 84, 101, 362/118, 190, 191; 116/202, 206

[56] References Cited

U.S. PATENT DOCUMENTS

| | | | |
|---|---|---|---|
| 2,774,860 | 12/1956 | Prebol et al. | 362/191 |
| 3,875,602 | 4/1975 | Miron | 362/34 |
| 4,064,428 | 12/1977 | Van Zandt | 362/34 |
| 5,008,780 | 4/1991 | Pennington-Ridge | 362/34 |
| 5,036,442 | 7/1991 | Brown | 362/191 |
| 5,303,133 | 4/1994 | Wagner | 362/191 |
| 5,416,670 | 5/1995 | Authier | 362/34 |

*Primary Examiner*—Y. Quach
*Attorney, Agent, or Firm*—William E. Pelton, Esq.

[57] ABSTRACT

A light pen comprises a barrel defining a chamber therein, a cap detachably mounted on the upper end of the barrel having a cavity defined therein, a luminous bar disposed in the cavity of the cap and received in the chamber of the barrel. The luminous bar can be reversed on the barrel to provide a warning.

2 Claims, 6 Drawing Sheets

LIGHT PEN

BACKGROUND OF THE INVENTION

1. Field of the Invention

The present invention relates to a light pen, and more particularly to a pen that receives a luminous bar therein to provide a warning signal.

2. Description of Related Art

People generally use a flashlight or a candle for emergency illumination. However, the flashlight can not be used when the battery is dead or the bulb is burned out and the candle may easily to cause a fire. To solve the above mentioned problems, a luminous bar was thus invented.

The luminous bar has a housing made of a transparent plastic, such as a polyethylene. A chemical liquid is in the housing. A sealed glass tube is also in the housing and provides another chemical liquid therein. When the glass tube is broken by bending the bar, the two chemical liquids are mixed together to generate light by a chemical reaction of the two liquids. The light will continue to illuminate a long time and will not harm the user.

With this feature, the luminous bar can be used for a warning signal when an emergency such as a failure of electrical system of an automobile at night. However, it is inconvenient to carry the luminous bar because it is easy to break. Therefore, this problem limits the use of the luminous bar.

Therefore, the present invention tends to mitigate and/or obviate the aforementioned problem by providing an improved pen having a luminous bar.

SUMMARY OF THE INVENTION

The main object of the present invention is to provide a light pen to carry a luminous bar that can be used as a warning.

The other object of the present invention is to provide a light pen with a decorative function by the luminous bar received in the pen.

Other objects, advantages and novel features of the invention will become more apparent from the following detailed description when taken in conjunction with the accompanying drawings.

DETAILED DESCRIPTION OF PREFERRED EMBODIMENT

Figure 1:
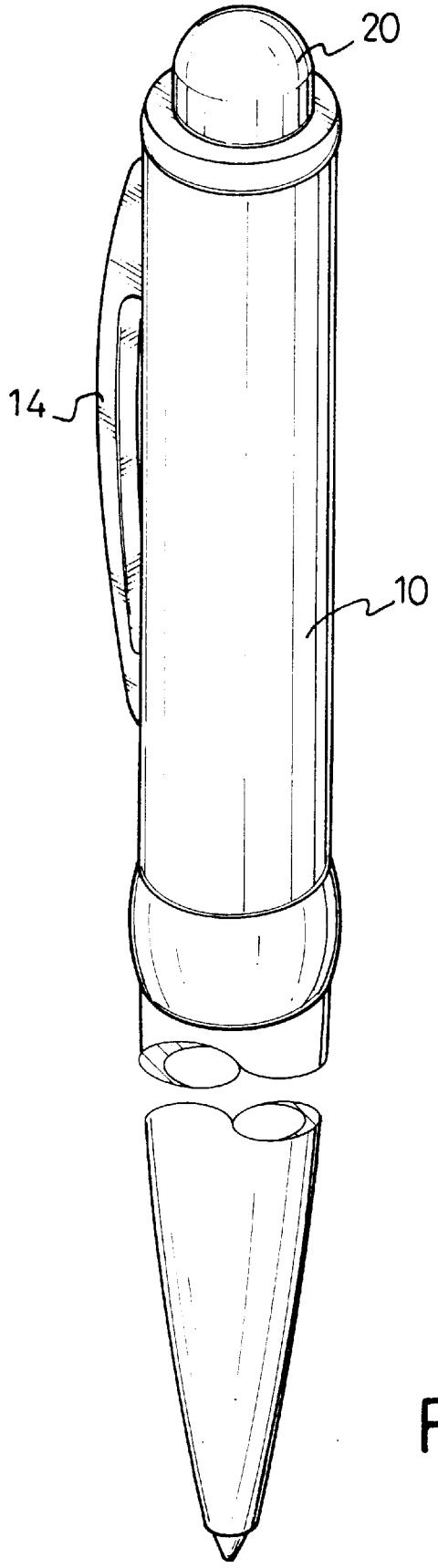
FIG. 1 is a perspective view of a preferred embodiment of the present invention.
Figure 2:
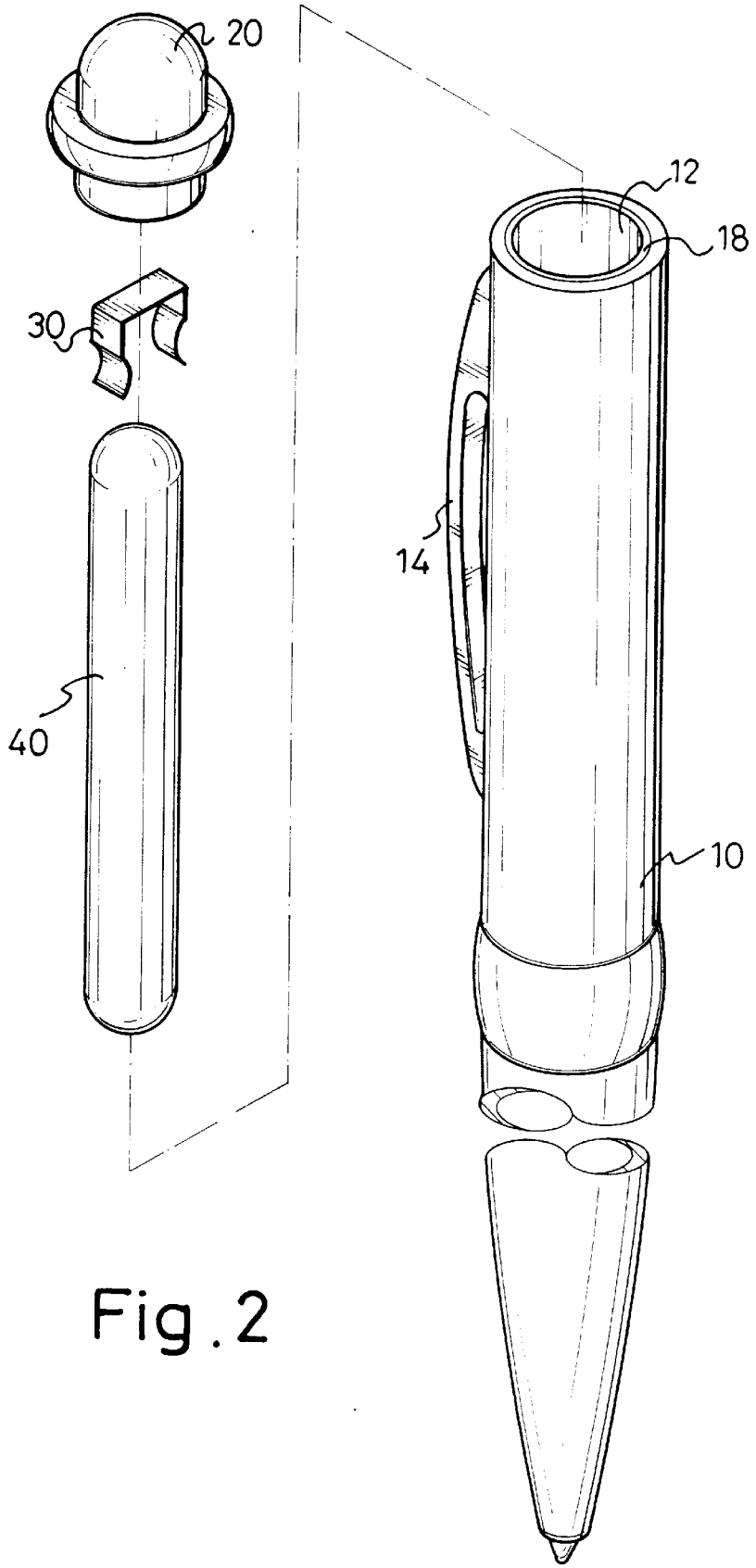
FIG. 2 is an exploded view of the light pen shown in FIG. 1.
Figure 3:
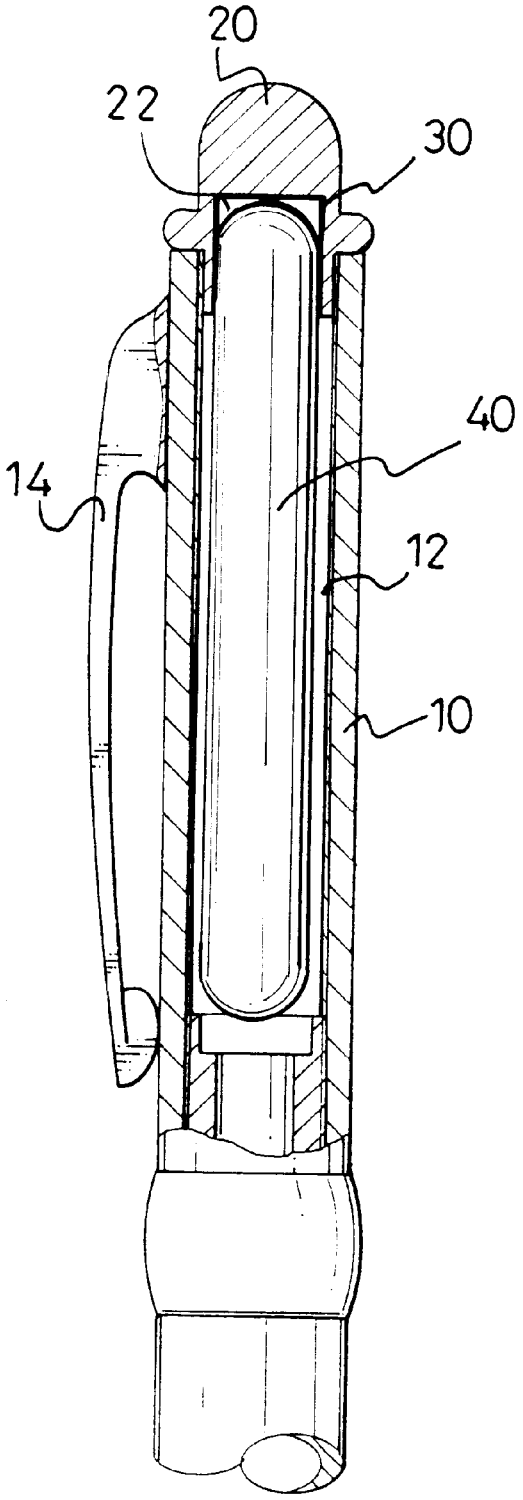
FIG. 3 is a partially sectional view of the light pen shown in FIG. 1.

Referring to FIGS. 1 and 2, the appearance of a light pen of the present invention is similar to that of a conventional pen. The light pen has a barrel (10) defining a chamber (12) therein, a pocket clip (14) an end of which is securely attached to the periphery of the barrel (10) and a cap (20) detachably engaged with the distal end of the barrel (10) and having a cavity (22) defined therein. A luminous bar 40 is received in the chamber (12). There is a bushing 18 disposed between the luminous bar (40) and the inner wall of the barrel (10). A clip (30) disposed within the cavity (22) of the cap (20) is for securely holding the luminous bar (40). FIG. 3 shows a configuration where the luminous bar (40) is held in the cavity (22) of the cap (20) by the clip (30) and received in the chamber (12) of the barrel (10).

Figure 4:
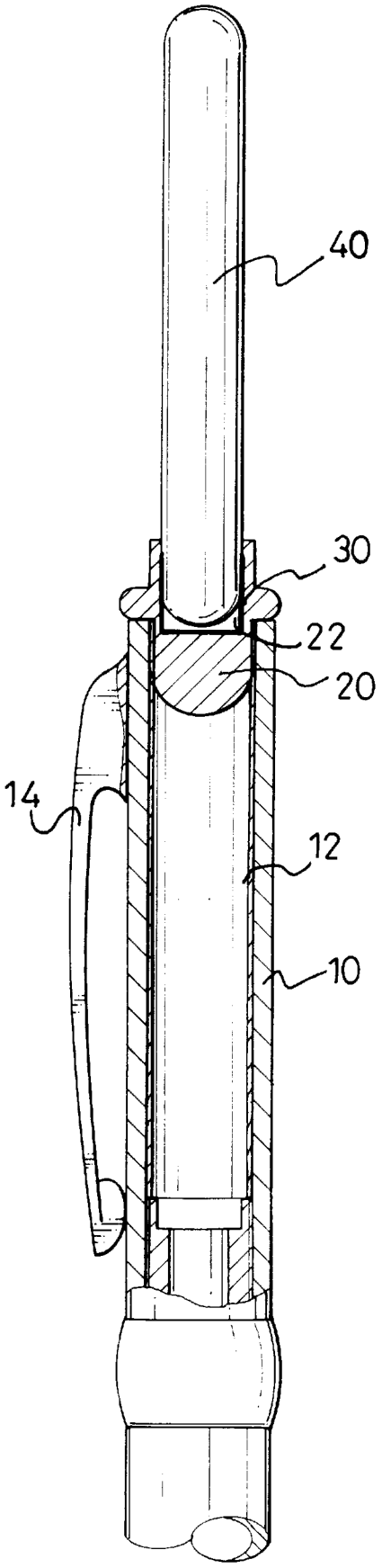
FIG. 4 is a schematic view showing the operation of the light pen.

In use, the cap (20) is reversed on the barrel (10) so that the luminous bar (40) held in the cavity (22) will be exposed, as shown in FIG. 4. The luminous bar (40) will thus generate light by mixing two kinds of liquids received within the bar (40), while a user can hold up the luminous bar (40) to provide a warning. The barrel (10) can also be placed in a proper location to be used as a mark.

Figure 5:
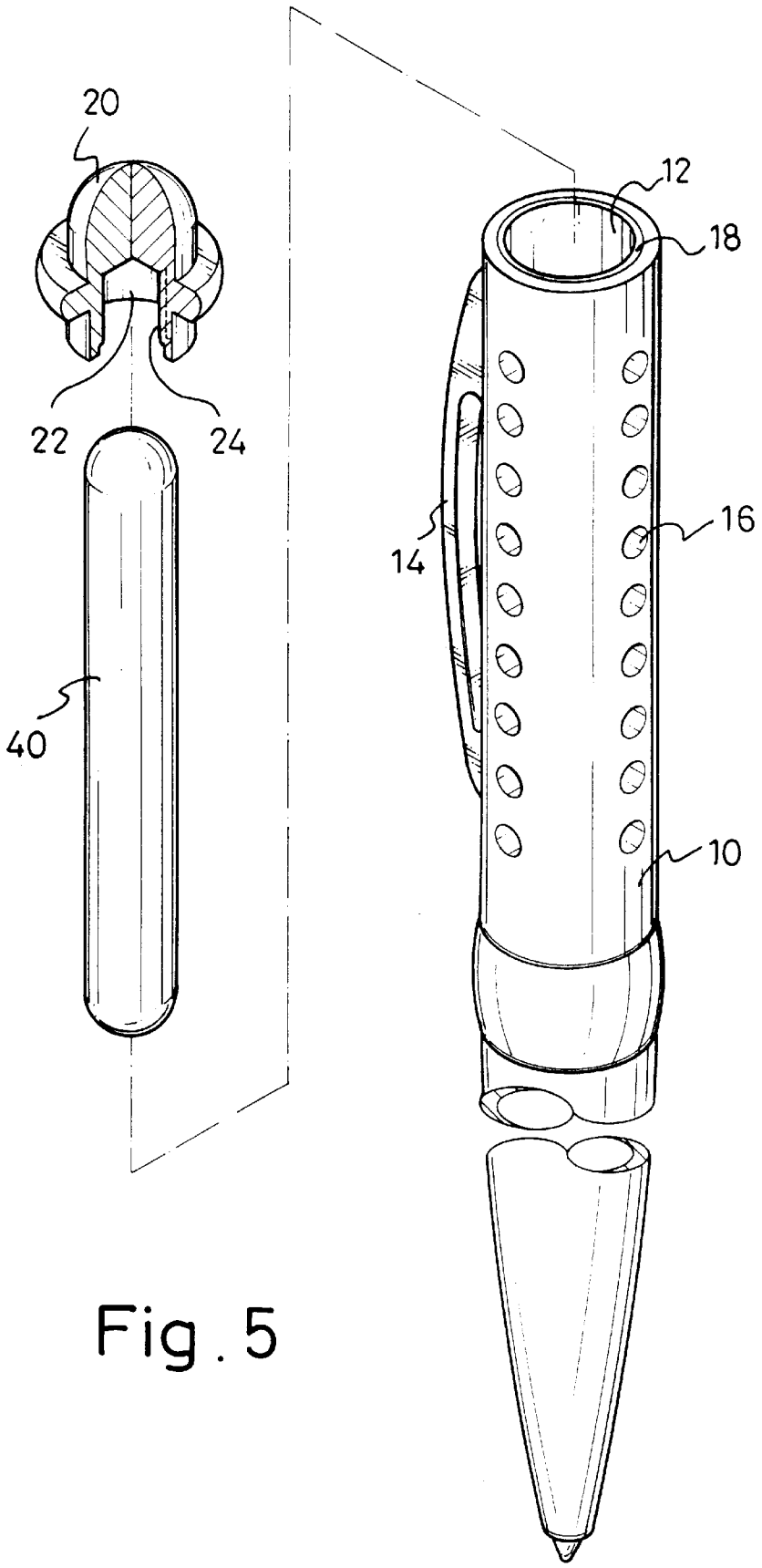
FIG. 5 is a perspective view of another preferred embodiment of the present invention.
Figure 6:
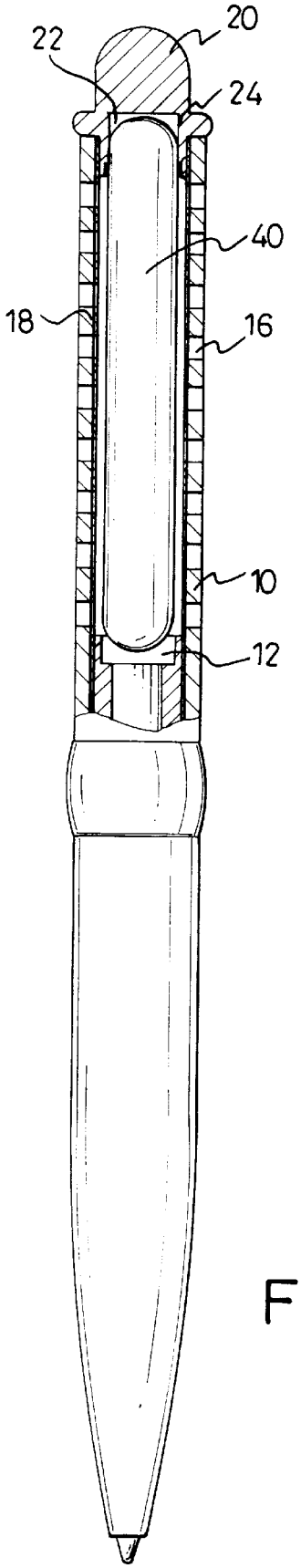
FIG. 6 is partially sectional view of the light pen shown in FIG. 5

Another preferred embodiment of the present invention is shown in FIGS. 5 and 6. The barrel (10) has a plurality of apertures (16) defined therein. The light of the luminous bar (40) received in the barrel (10) will be emitted from these apertures (16) to form a decorative image. The cavity (22) has a plurality of protrusions (24) formed therein instead of the clip (30) of the first embodiment to securely hold the luminous bar (40) in place.

The advantage of the present invention are:

1. It is easy to carry and use the luminous bar as it is received and protected in the barrel of the pen.

2. The barrel with a plurality of apertures will provide a decorative function.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An instrument comprising:

a writing utensil having a transparent barrel axially defining a chamber therein and having a first end and a second end, a plurality of apertures transversely defined through the barrel each connecting to the chamber;

a bushing mounted in the barrel;

a pocket clip mounted on the periphery of the barrel;

a transparent cap detachably mounted on the first end of the barrel and having a cavity defined therein;

a luminous bar securely mounted in the cavity of the cap and detachably received in the chamber of the barrel; and a clip secured in the cavity of the cap to hold the luminous bar securely in place.

2. An instrument comprising:

a writing utensil having a transparent barrel axially defining a chamber therein and having a first end and a second end, a plurality of apertures traversely defined through the barrel each connecting to the chamber;

a bushing mounted in the barrel;

a pocket clip mounted on the periphery of the barrel;

a transparent cap detachably mounted on the first end of the barrel and having a cavity defined therein, a plurality of protrusions formed in the cavity; and a luminous bar securely mounted in the cavity of the cap and retained by said plurality of protrusions, said bar being detachably received in the chamber of the barrel.

* * * * *